United States Patent [19]

Olson

[11] Patent Number: 4,464,098

[45] Date of Patent: Aug. 7, 1984

[54] INJECTION PUMP

[75] Inventor: John T. Olson, Edina, Minn.

[73] Assignee: Economics Laboratory, St. Paul, Minn.

[21] Appl. No.: 416,872

[22] Filed: Sep. 13, 1982

[51] Int. Cl.[3] ..... F04B 9/10

[52] U.S. Cl. ..... 417/397; 91/222; 91/275

[58] Field of Search ..... 417/397; 91/222, 275

[56] References Cited

U.S. PATENT DOCUMENTS

| | | | |
|---|---|---|---|
| 133,784 | 12/1872 | Lamb | 91/222 |
| 245,310 | 8/1881 | Morison | 91/222 |
| 1,447,962 | 3/1923 | Callaghan | 91/275 |
| 1,922,513 | 8/1933 | Wiedmann | 91/275 X |
| 1,953,454 | 4/1934 | Wollaeger | 91/275 X |
| 2,462,571 | 2/1949 | Thompson et al. | 91/275 X |
| 2,619,038 | 11/1952 | Davidson | 91/222 X |
| 2,757,645 | 8/1956 | Le Clair | 91/275 X |
| 2,960,971 | 11/1960 | Tear | 91/275 |
| 3,299,826 | 1/1967 | Williams | 91/275 X |
| 3,304,126 | 2/1967 | Rupp et al. | 91/275 X |
| 3,421,448 | 1/1969 | Brewer et al. | 91/275 X |
| 3,556,688 | 1/1971 | Hammelmann et al. | 417/397 |
| 3,622,250 | 11/1971 | Conlee | 417/397 |

*Primary Examiner*—Leonard E. Smith

*Attorney, Agent, or Firm*—Merchant, Gould, Smith, Edell, Welter & Schmidt

[57] ABSTRACT

An improved injector pump (10) is the subject matter of this application. The pump (10) includes a piston (44) freely disposed for reciprocation within a chamber (32). The piston (44) has an aperture (62) extending axially therethrough. A valve member (96) is disposed within the aperture (62) for rotation therein. Means are provided for rotating the valve member (96) between first and second positions, and operating fluid is channeled to opposite sides of the piston (44) depending upon the position of the valve member (96). Means (114, 118, 122, 124) are provided to move the valve member (96) between its first and second positions. Plungers (50, 52) extend in opposite axial directions from the piston (44) to effect pumping of the product fluid.

10 Claims, 15 Drawing Figures

FIG. 1
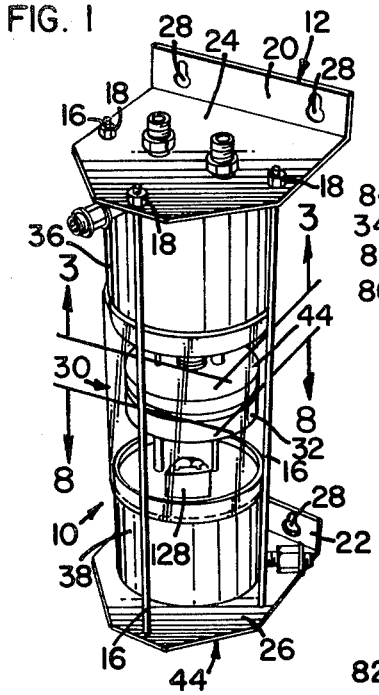
FIG. 5
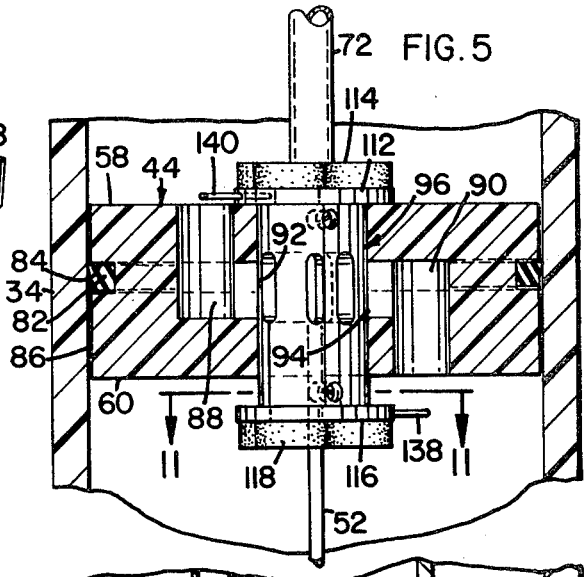
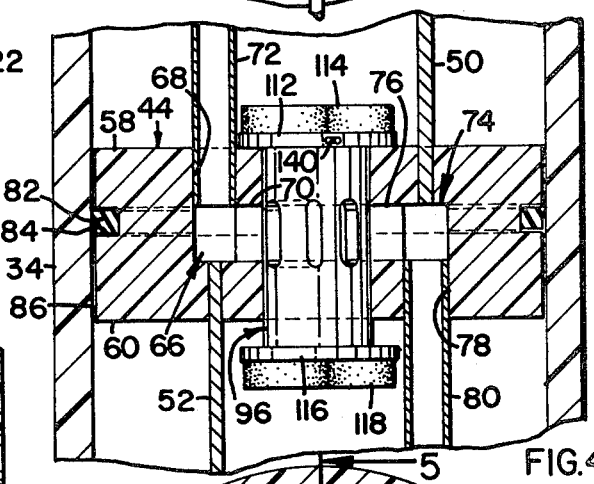
FIG. 4
FIG. 6
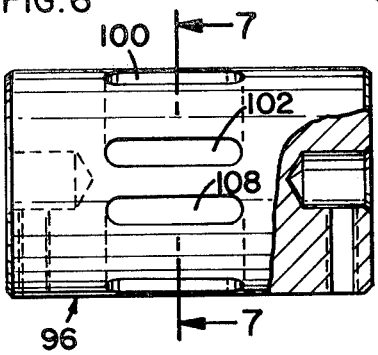
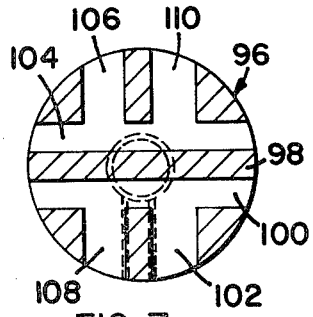
FIG. 7
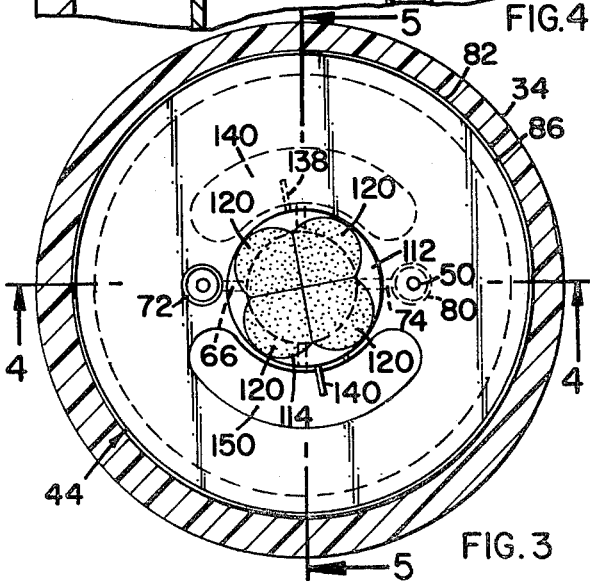
FIG. 3

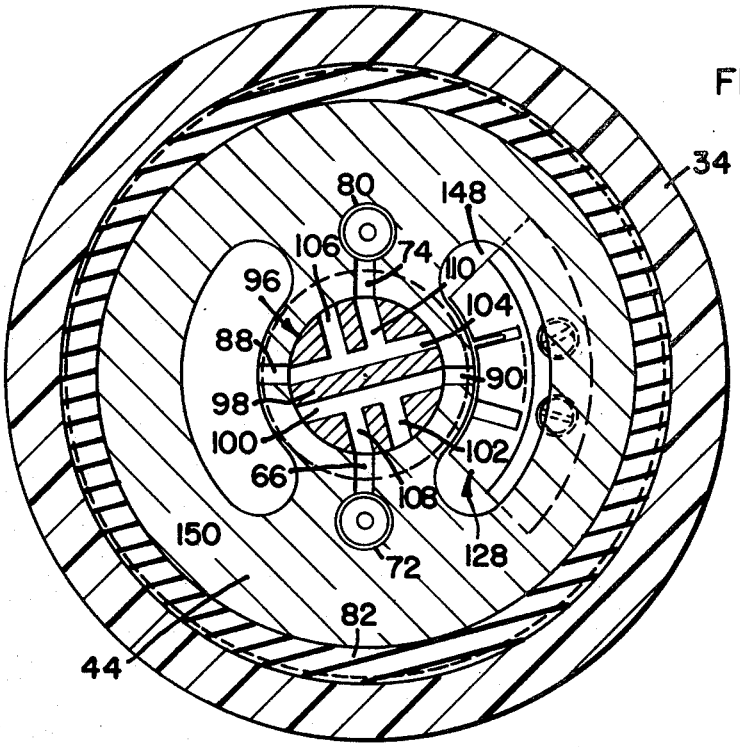
FIG. 10
FIG. 11
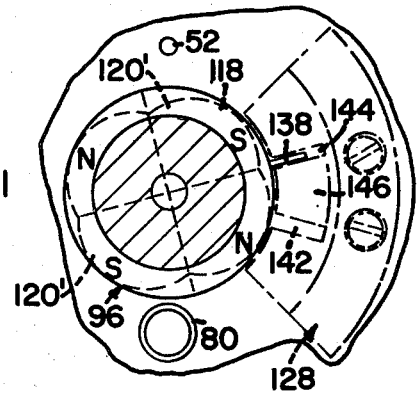
FIG. 12
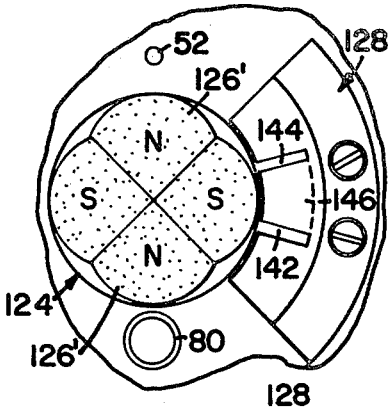
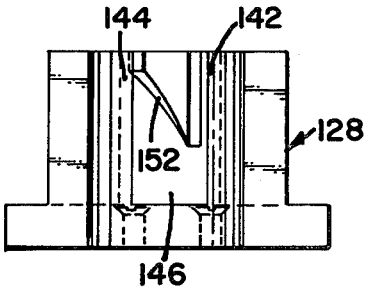
FIG. 15

INJECTION PUMP

TECHNICAL FIELD

The invention of the present patent application deals broadly with the field of pumps. More narrowly, however, it is related to the field of pumps used for transferring a fluid such as a liquid along a conduit from one location to another. Typically, it can be used in combination with a check valve assembly which insures fluid flow in a single direction. A typical application to which the pump can be put is the injection of a liquid such as a detergent or rinse additive into the washing or rinsing water, respectively, of a dishwashing machine.

BACKGROUND OF THE INVENTION

One of the most versatile machines known to man is the pump. The number of applications to which such a machine can be put is limited, virtually, only by man's imagination. Pumps are used in virtually all significant machines engineered during the twentieth century. One particular application to which pumps are put is that of injecting one liquid into another. For example, dishwashing machines, particularly those of a commercial or institutional nature, typically require that a detergent or rinse additive be injected into the wash water contained in the washing chamber.

Various types of pumps have been used to accomplish this fluid injection application. Such pumps usually have a pump chamber in which a piston is slidably disposed for reciprocation. When the piston moves through its stroke in one direction, the fluid will be expelled from the pump chamber. Check valve arrangements can be utilized in order to insure that flow of fluid is in only one, and the proper, direction.

Frequently, such pumps utilize an external power source such as hydraulic or electric power in order to move the piston through the pump chamber. When such a power source is utilized, significant expenses can be involved because of both complications arising from design and cost of operation. Energy consumption by such pumps typically tends to be high.

The prior art has attempted to solve some of these problems by eliminating a high energy consuming structure. One of such prior art pumps not having all of the disadvantages as discussed above is illustrated in U.S. Pat. No. 3,547,560. That patent is assigned to the assignee of the present application. The pump of that patent enables one fluid to be injected into another without the necessary utilization of a separate external power source. Such a pump conserves power, is less complicated than externally powered pumps and requires no electrical hook up or other power connection. Additionally, it is less expensive to manufacture, purchase, and install.

The pump of U.S. Pat. No. 3,547,560 includes a pump body having an elongated chamber in which a dual acting piston is received. The piston has two opposed working faces with one of the faces having a diameter smaller than the other face. Additionally, the piston is normally biased by a spring to a first position wherein the piston is located relative to the pump body to form a first compartment adjacent one of the faces of the piston. A supply of the fluid to be injected is contained in this first compartment.

The pump body is connected adjacent the other face of the piston to a water conduit such as a supply line for a dishwashing machine into which the detergent or rinse additive is to be injected. A pressurized flow of water is directed through this conduit. As water starts flowing, some of the water will be directed by the conduit against the other face of the piston to force the piston upwardly against the bias of the spring. As the piston is forced upwardly, it dispenses the fluid contained in the first compartment through a metering device to a conduit which is itself connected to the pressurized water flow conduit. Such a configuration is designed to slowly meter fluid flow into the water conduit in order to effect a thorough mixing of the fluid with the water.

This type of pump has achieved a large measure of commercial success. It does, however, have disadvantages. It does not allow the amount of detergent or rinse additives being injected to be adjusted without varying the rate of inflow of washing water into the washing chamber.

The invention of the present application is an improved injection pump for injecting detergents and rinse additives as discussed above. It not only conserves power, is less complicated than many pumps presently in use for this application, and requires no electrical hookup or other power connection, but it also allows the rate of fluid injection to be varied independently of the flow of washing water into the machine's chamber.

SUMMARY OF THE INVENTION

The invention of the present application is apparatus used to drive the plunger of an injection pump in a reciprocating motion. In such a pump, a plunger is disposed within a cylinder for reciprocation therein along an axis of the cylinder. The cylinder is placed in fluid communication with a transfer line through which a product to be injected is moved. As the plunger moves in a direction away from the transfer line, it draws the product through the transfer line in a desired direction and beyond a first one-way flow valve. As the plunger moves in the opposite direction, it pumps the product beyond a second one-way flow valve to a recipient container. The apparatus for driving the plunger includes a housing which defines a chamber. The chamber has opposite ends with respect to an axis aligned in a direction in which the plunger reciprocates. A piston is received in the chamber and disposed for reciprocating movement along the axis of the chamber. The piston is operatively connected to the plunger so that, as the piston reciprocates, so does the plunger. An operating fluid is channeled to the piston, passes through the piston, and is conducted away therefrom. The piston carries means for alternatively directing the operating fluid to opposite sides thereof. A change of the side of the piston to which the fluid flow is directed is effected as the piston approaches an axial end of the chamber. When the piston approaches one end, fluid, formerly having been directed to the opposite side of the piston, will now be directed to the side facing the end of the chamber which the piston is approaching.

In a preferred embodiment, the piston is provided with a circular aperture therethrough. A circularly cylindrical wall is, thereby, defined. An inlet conduit is provided to conduct operating fluid to an inlet passageway which extends between a surface of the piston and an exit at the cylindrical wall. An outlet conduit is attached to the piston and conducts operating fluid away from an outlet passageway which has an entrance at the cylindrical wall and an exit at the surface of the piston.

The piston can also have first and second channels formed therein. The channels can extend from the cylindrical wall to opposite surfaces of the piston.

A valve member having an axially extending baffle can be rotatably disposed in the circular aperture formed in the piston. The valve member can be disposed for movement between first and second positions, and means can be provided for rotating the member between these positions as the piston alternately approaches opposite axial ends of the chamber. In the first position of the valve member, the baffle would be aligned so that the exit of the inlet passageway and a first port to one of the channels are in fluid communication on one side thereof and the entrance of the outlet passageway and a second port to the other of the channels are in fluid communication on an opposite side thereof. In a second position of the valve member, the baffle would be aligned so that the exit of the inlet passageway and the second port are in fluid communication on one side thereof and the entrance of said outlet passageway and the first port are in fluid communication on an opposite side thereof.

The valve member can be rotated between its first and second positions by providing the valve member with a first pair of axially aligned magnet members, one mounted to each oppositely facing axial surface of the valve member. Similarly, opposite axial ends of the chamber can be provided with a second pair of axially aligned magnet members in axial alignment with the first pair of members. The magnet members can include angularly alternating portions of opposite polarity. The alternating portions of the various members can be arranged so that, as the valve member approaches one end of the chamber, portions of like polarity will repel each other to rotate the valve member. With the valve member in this rotated position and moving toward the opposite end of the chamber, portions of polarity of the magnet members can be so arranged so that, as the piston approaches the opposite end, repelling of opposed portions will effect rotation of the valve member back to its original position.

The strength of the magnet member portions would be sufficient to effect rotation of the valve member between its two positions. At the same time, however, they would not be so strong so as to prevent movement of the piston along the axial length of the chamber.

In order to effect the full desired rotation of the valve member from one position to another, means can be provided for preventing rotation until the piston is closely proximate an end of the chamber. A track member can be mounted within the housing at each end of the chamber, each of the track members being provided with a radially inwardly facing wall. A pair of axially extending, generally parallel slots can be formed in the wall, and a third slot intersecting the first and second slots can be provided to connect the parallel slots.

The valve member can be structured with a track rider extending generally radially therefrom. In the first position of the valve member, the track rider would be received within a first of the parallel slots. In a second position of the valve member, the track rider would be received within the second slot. Receipt of the track rider in one of the slots would prevent rotation of the valve member. As the piston approached and end of the chamber, the rider would become aligned with the third slot, and the valve member would be allowed to rotate.

The invention of the present application is, thus, apparatus which solves problems existent in the prior art. More specific features and advantages obtained in view of those features will become apparent with reference to the detailed description of the invention, the claims, and the appended drawing figures.

BRIEF DESCRIPTION OF THE DRAWINGS

FIG. 1 is a prospective view of an injector pump in accordance with the invention of the present application;

FIG. 3 is a view taken generally along the line 3—3 of FIG. 1;

FIG. 4 is a view taken generally along the line 4—4 of FIG. 3;

FIG. 5 is a view taken generally along the line 5—5 of FIG. 3;

FIG. 6 is an elevational view of the valve member;

FIG. 7 is a view taken generally along the line 7—7 of FIG. 6;

FIG. 10 is a view similar to that of FIG. 8, but with the valve member in its second position;

FIG. 11 is a view similar to that of FIG. 9, but with the valve member in its second position;

FIG. 12 is a portion of a enlarged plan view of one end of the chamber;

FIG. 15 is an elevational view illustrating a track member.

DETAILED DESCRIPTION OF THE INVENTION

Figure 2:
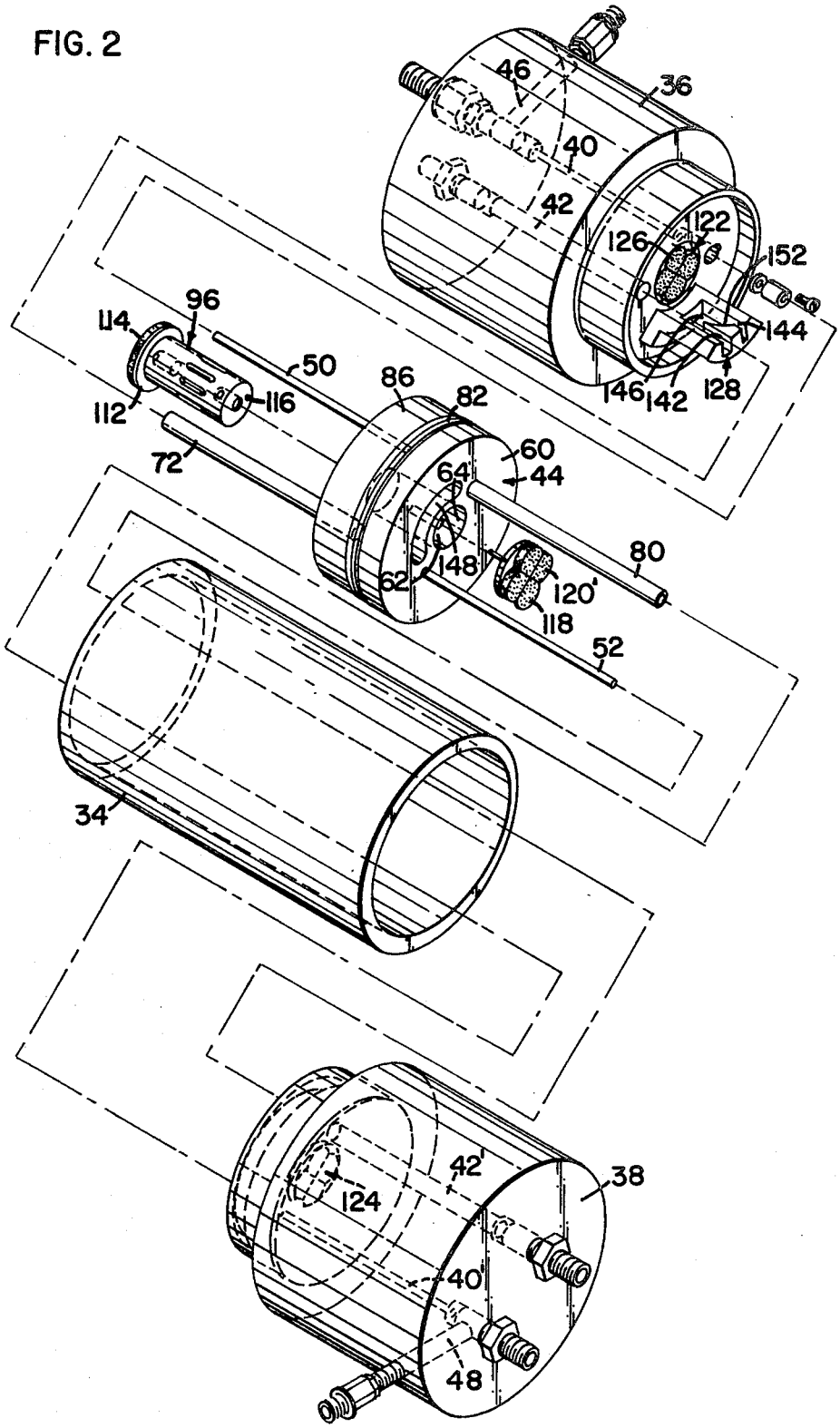
FIG. 2 is an exploded perspective view of the pump of FIG. 1.

Referring now to the drawings wherein like reference numerals denote like references throughout the several views. FIG. 1 illustrates an injector pump 10 in accordance with the invention of the present application. The pump 10 can be mounted in an appropriate location by use of upper and lower mounting plates 12, 14, the plates being secured to ends of the pump 10 by a plurality of longitudinally extending rods 16. The rods 16 are threaded at ends thereof, and the threaded ends are disposed extending slightly beyond the plates 12, 14.

As will be apparent, the rods 16 are made to a length slightly longer than the pump 10 itself. Nuts 18 can be affixed to the threaded ends, and as the nuts 18 are tightened down, the plates 12, 14 will be brought into tight engagement with the pump 10.

Each plate 12, 14 can be provided with a flange 20, can be provided with eyelets 28 which can be used in mounting the plate mounted pump to a wall.

The pump 10 includes a housing 30 which defines a chamber 32 centrally therein. The chamber 32 is surrounded by an encircling wall 34 and is closed at either axial end by a plug 36, 38.

As best seen in FIG. 2, each plug 36, 38 is provided with a pair of conduits 40, 42 extending axially therethrough. In a preferred embodiment, one 40, 42 of each pair functions to channel an operating, or control, fluid to or from a piston 44 disposed for reciprocation within the chamber 32, and the other 40, 40' functions as a cylinder into which a product, to be pumped through a transfer line 46, 48, is drawn as a plunger 50, 52 is withdrawn in the conduit 40, 40' to create a suction therein.

Each transfer line can include first and second one-way flow valves (not shown) interposed therein. A first one-way flow valve, or check valve, is interposed in the line 46 up flow of the cylinder 40. As the plunger 50 is withdrawn away from the valve, product in the line will be drawn past the valve and into the cylinder 40. As the plunger 50 moves in an opposite direction, the product will be forced past the second check valve in a desired direction toward a recipient container. In this manner, the product can be pumped from a reservoir to a container which, when the product is a fluid such as a detergent, can be a washing machine.

The pair of conduits 40', 42' in the second plug 38 can serve similar functions. In that plug 38, however, one of the conduits 42' can serve to convey the control fluid away from the piston 44 while the other one serves as a second cylinder 40', having a second plunger 52 received therein, for pumping of product to a desired end use location. As can be seen, therefore, as the piston 44 moves in opposite axial directions, one or the other of the plungers 50, 52 will move in a direction to effect forcing of product through a transfer line 46, 48.

Referring now to FIGS. 3, 4, and 5, the structure of the piston 44 disposed for reciprocation is illustrated. When the pump 10 is disposed in a generally vertically extending orientation, the piston 44 has an upper, or first, surface 58, and a lower, or second, surface 60. These surfaces 58, 60 face oppositely along an axis along which the piston 44 reciprocates.

The piston 44 is provided with a circular aperture 62 extending therethrough from the first surface 58 to the second surface 60. As seen in the figures, the aperture 62 extends generally normal to planes defined by the first and second surfaces 58, 60 and is disposed centrally in the piston 44.

The aperture 62 defines a circularly cylindrical wall 64. When the axis of the aperture 62 is normal to the planes defined by the first and second surfaces 58, 60 of the piston 44, this circularly cylindrical wall 64 is genearlly parallel to a circularly cylindrical wall of the pump housing 30.

An inlet passageway 66 is formed within the piston 44. It has an entrance 68 at the first surface 58 of the piston 44 and an exit 70 at the circularly cylindrical wall 64 defined by the central aperture 62. As best seen in FIG. 4, a portion of an inlet conduit 72, which slides in passageway 42, can be recessed within the inlet passageway 66 in order to maintain the conduit 72 in a fixed position relative to the piston 44.

Similarly, the piston 44 can have an outlet passageway 74 formed therein. The outlet passageway 74 has an entrance 76 at the circularly cylindrical wall 64 defined by the aperture 62 through the piston 44 and an exit 78 at the second surface 60 of the piston 44. As in the case of the inlet conduit, an outlet conduit 80, which slides in passageway 42', can have a portion thereof recessed within the outlet passageway 74 to maintain the outlet conduit 80 in a fixed relationship to the piston 44.

As seen in the figures, the inlet and outlet conduits 72, 80 are shown as extending from the piston 44 in opposite directions and the inlet and outlet passageways 66, 74 as being at diametrically opposed locations about the piston 44. It will be understood that such structure, although existent in the preferred embodiment, is not essential to the invention.

FIG. 4 best illustrates a pair of plungers 50, 52, each generally aligned axially with one of the inlet and outlet conduits 72, 80. The plungers 50, 52 extend from the piston 44 and into a cylinder 40, 40' in communication with a product transfer line 46, 48 as previously described herein. When the piston 44 is made to reciprocate in a manner to be described hereinafter, one plunger will be passing the product through the transfer line to its ultimate destination as the piston 44 moves in one direction, and the other plunger will be withdrawing within its cylinder to create a suction therein to draw product inwardly. As the direction of reciprocation of the piston 44 reverses, the operation of the plungers 50, 52 will reverse. Consequently, at any one time, either one or the other of the plungers will be urging the product through one of the product transfer lines.

A seal 82 can be provided within a recess 84 formed in a radially outwardly facing surface 86 of the piston 44 to segregate fluid in that portion of the chamber 32 on one side of the piston 44 from fluid in the chamber 32 on the other side of the piston 44. Seals can also be provided about each of the plungers 50, 52 within their respective cylinders 40, 40' in order to isolate the operating fluid which passes through the inlet conduit 72, the piston 44, the chamber 32, and the outlet conduit 80 from the product being pumped through the product transfer lines 46, 48. These seals are not shown in the figures.

Referring now to FIG. 5, the piston 44 also has first and second channels 88, 90 formed therein. The first channel 88 provides passage from a first port 92 formed in the circularly cylindrical wall 64 through the piston 44 to the first surface 58 of the piston 44 and that portion of the chamber 32 which the first surface 58 faces. Similarly, the second channel 90 provides fluid communication between a second port 94 at the circularly cylindrical wall 64 and the second surface 60 of the piston 44 and that portion of the chamber 32 which the second surface 60 faces. As in the case of the positioning of the inlet and outlet passageways 66, 74, the first and second channels 88, 90 can be positioned diametrically opposed from one another. In the preferred embodiment, an axis through the channels 88, 90 is spaced 90° angularly from an axis through the inlet and outlet passageways 66, 74.

As best seen in FIGS. 4 and 5, a valve member 96 is disposed in the circular aperture formed in the piston 44. The valve member 96 is circular in cross-section, as seen in FIG. 7, and has an outside diameter closely approximating the diameter of the aperture 62. The valve member 96 is rotatably disposed within the aperture 62 and free to be moved between a first position and a second position as will be discussed hereinafter.

Referring now to FIGS. 6 and 7 wherein the valve member 96 is more particularly illustrated, the valve 96 is provided with a baffle 98 which extends axially through a distance at least partially axially coextensive with the exit 70 of the inlet passageway 66, the entrance 76 to the outlet passageway 74, and the first and second ports 92, 94. The baffle 98 is shown as bifurcating the valve member 96 into two 180° portions.

Although not essential to the invention, passageway networks are defined on either side of the baffle 98 for alignment with the passageways 66, 74 and channels 88, 90 formed in the piston 44 as the valve member 96 is rotated between its first and second positions. It will be understood, however, that the passageway networks are not essential to the invention and that a single axially extending baffle 98 can function to effect fluid flow as discussed hereinafter.

Figure 8:
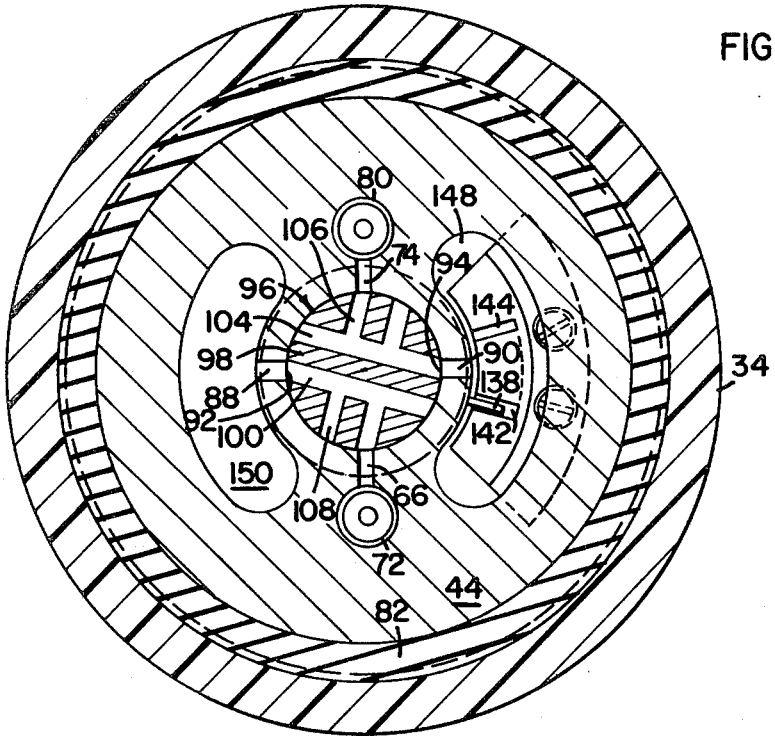
FIG. 8 is a view taken generally along the line 8—8 of FIG. 1 with the valve member shown in its first position.

FIG. 8 illustrates the first position of the valve member 96 relative to the piston 44, and FIG. 10 illustrates the second position of the valve member 96 relative to the piston 44. When the valve member 96 is in its first position, a main passageway 100 of the network on a first side of the baffle 98 registers with the first port 92. A first branch passage 102 of the network registers with the inlet passageway 66. Similarly, a main passage 104 of the network on the second side of the baffle 98 registers with the second port 94, and a first branch 106 passage of that network registers with the outlet passageway 74.

As can be seen in FIG. 10, when the valve member 96 is in its second position, the main passage 100 of the network on the first side of the baffle 98 registers with the second port 94, and a second branch passage 108 of the network registers with the inlet passageway 66. With the valve member 96 in this position, the main passage 104 of the network on the second side of the baffle 98 registers with the first port 92, and a second branch passage 110 of the network registers with the outlet passageway 74.

As can be seen in FIGS. 8 and 10, the branch passages of the networks not actually in registration with either the inlet or outlet passageway 66, 74 are occluded by the circularly cylindrical wall 64 defined by the aperture 62 formed through the piston 44. It will be understood, however, that, with the valve member 96 in its first position, the second branch passages 108, 110 serve no function. Similarly, with the valve member 96 in its second position, the first branch passages 102, 106 serve no function.

Means are provided for automatically rotating the valve member 96 between its first and second positions. The valve member 96 has a first axially facing surface 112 on which is mounted one 114 of a first pair of magnet members. Similarly, a second, oppositely facing axial surface 116 of the valve member 96 has a second 118 of the first pair of magnet members mounted thereto. As seen in the drawing figures, and particulary FIGS. 13 and 14, each of the pair of magnet members comprises four angular sectional magnet portions 120, 120', each measuring 90° in measure. Angularly adjacent portions are of opposite polarity.

Figure 13:
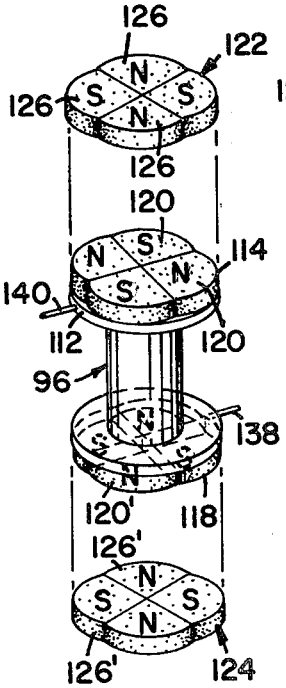
FIG. 13 is a schematic view illustrating a first magnet member portion arrangement.

The first 122 of a second pair of magnet members is mounted at an axial end of the chamber 32 in axial alignment with one of the first pair of magnet members 114. Similarly, the second 124 of the second pair of magnet members is mounted at an opposite end of the chamber 82 in axial alignment with the second of the first pair of magnet members 118. As in the case of the first magnet members, each member comprises four 90°, angularly sectioned portions 126, 126'. Adjacent portions are also made of opposite polarity. As seen in FIG. 13, one embodiment contemplates axial alignment of portions 126, 126' of similar polarity of the second pair of magnet members. In that embodiment, portions 120, 120' of the first pair of magnet members of opposite polarity are aligned axially.

In a second embodiment, portions of the first pair of magnet members of similar polarity are aligned axially, while portions of the second pair of members of opposite polarity are in alignment axially.

As will be seen when reviewing the description of the operation of the injector pump 10, it is advantageous to preclude any movement of the valve member 96 between its first and second positions other than when the piston 44 is closely proximate an end of the chamber 32. To this end, a track member 128 can be provided at each end of the chamber 32. The track member 128 is seen, in relation to its surroundings, in FIGS. 8 through 12 and, in isolation, in FIG. 15.

The member 128 includes an arcuate portion 130 and a flange portion 132. The track member 128 can be secured to a surface of a plug 36, 38 facing axially inward into the chamber 32 by screws 134 passing through the flange portion 132 and into the plug 36, 38.

Figure 14:
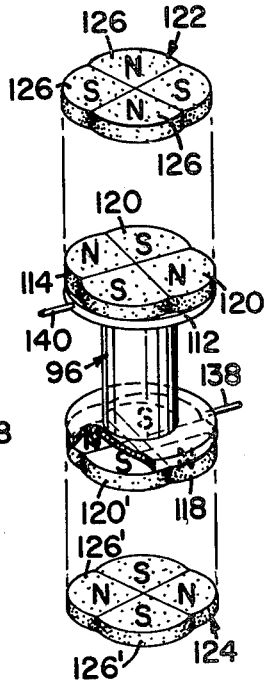
FIG. 14 is a schematic view illustrating a second magnet member portion arrangement.

The track member 128 can be secured relative to the position of the valve member 96 when the piston 44 is proximate the particular end of the chamber 32 so that the magnet member on that side of the piston will fit closely within the radially inwardly facing wall 136 of the track member 128. Each first magnet member 114, 118 is provided with a track rider 138, 140 which extends radially therefrom. As can be seen in FIGS. 13 and 14, these track riders 138, 140 are shown to extend in opposite directions from their respective magnet members 114, 118. Since these track riders 138, 140 cooperate with slots formed in the radially inwardly facing wall 136 of the track member 128 in a manner to be described hereinafter, the track members are, similarly, disposed at 180° from one another with respect to the axis of the chamber 32.

Each track member 128 is provide with first, second, and third slots 142, 144, 146. The first and second slots 142, 144 extend axially along the wall 136 in a parallel fashion. The third slot 146 interconnects the first and second slots 142, 144 closely proximate the end of the chamber 32.

As the piston 44 moves toward one end of the chamber 32, the track rider 138 extending from the magnet member facing the end of the chamber 32 toward which the piston 44 is moving will be aligned with the first slot 142. The track rider 138 is sized similarly to the first slot 142 and the second slot 144 so that there will be little play between the rider 138 and the sidewalls of the slots 142, 144.

Figure 9:
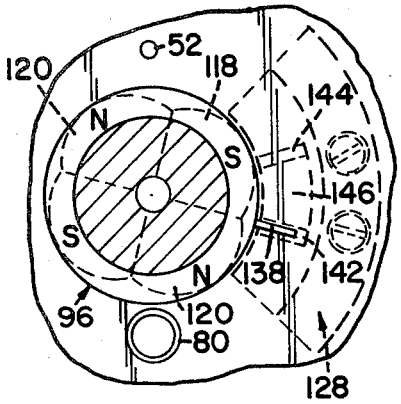
FIG. 9 is a view showing the relative positioning of portions of a first magnet member with the valve member in the position illustrated in FIG. 8.

As the rider 138 enters the first slot 142 and the piston 44 more closely approaches the end of the chamber 32, the configuration of the magnet members, as discussed hereinafter, will tend to urge the valve member 96 from its first position as seen in FIG. 9, to its second position as seen in FIG. 11. This movement will be precluded by the sidewalls of the first slot 142 until the piston 44 moves sufficiently far axially toward the end of the chamber 32 at which position the rider 138 will register with the third slot 146. At that point, the repelling action of the magnet members will be the strongest, and there will be no obstacle to preclude movement of the valve member 96 to its second position. The track rider 138 will, therefore, move along the third slot 146 until it is in a position aligned with the second slot 144. With the valve member 96 in its second position, operating fluid will be rechanneled through the piston 44 to urge the piston in the opposite direction. At the other end of the chamber, the other track rider 140 will cooperate with the other track member in a similar manner to preclude rotation of the valve member 96 back to the first position until the piston 44 is closely proximate the end of the chamber 32.

Operation

Operation of the injector pump 10 will be described with reference to FIGS. 4, 5, and 8 through 12. Operating or control fluid passes through the inlet conduit and into the piston 44 through the entrance 68 of the inlet passageway 66. The fluid, when the valve member 96 is in its first position, will pass through the exit 70 of the inlet passageway 66 and into the first branch passage 102 of the network on the first side of the baffle 98. The control fluid, thereafter, can only pass into the main passage 100 of the network and exit through the first port 92 and into the first channel 88. The first channel 88 is shown as communicating with an arcuate recess 150 formed in the piston 44 from the first side 58 thereof. The control fluid can, thereby, exit into the chamber 32 on the first side 58 of the piston 44.

Channeling of control fluid in this manner will increase the volume of fluid on the first side 58 of the piston 44 and urge the piston in a direction away from the portion of the chamber 32 into which the fluid is being pumped. Control fluid on the other side of the piston 44 will, therefore, enter a second arcuate 150 recess formed in the piston 44 and communcating with that portion of the chamber 32 which is faced by the second surface 60 of the piston 44. The second channel 90 provides communication between this second recess 148 and the main portion 104 of the second network on the opposite side of the baffle 98. The control fluid will, thereafter, be able to enter only the first branch passage 106 of the second network which is in registration with the outlet passageway 74. The fluid will pass into the outlet passageway 74 and into the outlet conduit 80 to drain or to be returned to a reservoir.

As the piston 44 is driven in this manner toward one end of the chamber, a first track rider 138 will enter the first slot 142 of one of the track members 128. The one first magnet member 118 which is approaching the end of the chamber will be in the position as seen in FIG. 9. The one second magnet member 124 which it is approaching is oriented as seen in FIG. 12. That portion 120' of the first magnet member 118 with a north polarity in the lower right quadrant, as seen in FIG. 9, will be more closely aligned with that segment 126' of the second magnet member 124 having north polarity in the lower quadrant, as seen in FIG. 12. The tendency will be for the valve member 96 to be rotated in a counterclockwise direction as viewed in FIG. 9. This will, of course, be precluded as long as the track rider 138 engages the wall of the first slot 142 in the track member 128.

Since no rotation of the valve member 96 has occurred, the piston 44 will continue to move in the direction toward the second magnet member 124 of FIG. 12. At a point, the track rider 138 will be free to slide angularly once it has become aligned with the third slot 146. Angular movement will be approximately 30° to the second position as seen in FIG. 11.

In its second position, that portion 120' of the first magnet member 118 having a north polarity in the lower right quadrant, as seen in FIG. 11, will be more closely aligned with that portion 126' of the second magnet member 124 having a south polarity in the right most quadrant, as seen in FIG. 12. Perfect alignment will, however, be precluded by the wall of the second slot 144.

With the valve member 96 in its second position, operating fluid, still being directed through the inlet conduit 72, will be channeled through the second branch passage 108 of the first network and into the second channel 90 through the second port 94. The fluid will, thereafter, pass through the second arcuate recess 150 and into the portion of the chamber 32 faced by the second surface 60 of the piston 44. Such channeling will, thereby, cause the piston 44 to move in an opposite direction.

As can be seen in FIG. 15, the entrance to the second slot 144 can be enlarged and have a tapered wall 152 tapering down to the normal width of the slot. Should the valve member 96 not be completely rotated to its second position wherein proper alignment of ports 92, 94 and passageways 66, 74 is effected, slight movement of the piston 44 will bring the track rider 138 to bear against the sloped wall 152, and the valve member 96 will, in turn, become completely rotated to its second position as the track rider 138 rides along this sloped wall 152.

As the piston 44 continues in this reciprocal direction, it will approach the opposite axial end of the chamber 32 and a second track rider 140 will enter the first slot of a second track member. The relative magnet member positioning at this end of the chamber 32 will be such that the valve member 96 will be rotated back to its first position.

A first magnet member configuration which can be used is shown in FIG. 13. As seen in that figure, axially aligned portions 126, 126' of the second magnet members 122, 124 are of like polarity, while axially aligned portions 120, 120' of first magnet members 114, 118 are of opposite polarity. With such a configuration, portions of one of the first magnet members will be axially aligned with portions of a facing second magnet member of like polarity, while portions of the opposite first magnet member are aligned with portions of its facing second magnet member of opposite polarity. Such a disposition of the magnet member portions will effect the rotation of the valve member 96 between its first and second positions as desired.

FIG. 14 illustrates a second configuration of the magnet members which can effect the desired rotation. In that embodiment, axially aligned portions 120, 120' of the first magnet members 114, 118 are of a like polarity, while axially aligned portions 126, 126' of the second magnet members 122, 124 are of opposite polarity. As in the case of the embodiment shown in FIG. 13, substantially aligned magnet member portions of one first magnet member and its facing second magent member will be of like polarity when substantially aligned magnet member portions of the other first magnet member and its facing second magent member are of opposite polarity. This configuration will also effect the desired rotation between first and second positions of the valve member.

Numerous characteristics and advantages of the invention have been set forth in the foregoing description. It will be understood, of course, that this disclosure is, in many respects, only illustrative. Changes can be made in details, particularly in matters of shape, size, and arrangement of parts without exceeding the scope of the invention. The invention's scope is defined by the language in which the appended claims are expressed.

What is claimed is:

1. An apparatus for driving a plunger of an injector pump, which plunger reciprocates to effect transfer of a liquid from a reservoir to a location at which the liquid is to be injected, comprising:

(a) a housing defining a chamber;

(b) a piston connected to the plunger and disposed within said chamber for free reciprocation therein along an axis oriented in a direction in which the plunger reciprocates, said piston having first and second surfaces facing oppostively along said axis and defining therein:

(i) a circular aperature extending through said piston axially to define a circularly cylindrical wall;

(ii) an inlet passageway having an entrance at a surface of said piston and an exit at said wall;

(iii) an outlet passageway having an entrance at said wall and an exit at a surface of said piston;

(iv) a first channel providing fluid communication between said first surface and a first port in said wall; and (v) a second channel providing fluid communication between said second surface and a second port in said wall;

(c) an inlet conduit attached at said entrance of said inlet passageway through which conduit a fluid is pumped to said piston;

(d) an outlet conduit attached at said exit of said outlet passageway, through which conduit fluid exits said piston;

(e) a valve member including an axially extending baffle and being rotatably disposed in said circular aperture for movement between a first position wherein said exit of said inlet passageway and said first port are in fluid communication on one side thereof and said entrance of said outlet passageway and said second port are in fluid communication on an opposite side thereof, and a second position wherein said exit of said inlet passageway and said second port are in fluid communication on one side thereof and said entrance of said outlet passageway and said first port are in fluid communication on an opposite side thereof; and (f) means for rotating said valve member from its first to its second position as said piston approaches one end of said chamber and from its second to its first position as said piston approaches and opposite end of said chamber.

2. Apparatus in accordance with claim 1 wherein said valve member has first and second surfaces proximate said first and second surfaces, respectively, of said piston, and wherein said rotating means comprises:

(a) a first pair of axially aligned magnet members, one mounted to each of said first and second surfaces of said valve member centrally thereon, said magnet members including angularly alternating portions of opposite polarity; and (b) a second pair of axially aligned magnet members, one mounted at each of opposite axial ends of said chamber in axial alignment with said first pair of magnet members, said second pair of magnet members also including angularly alternating portions of opposite polarity corresponding in angular measure to said portions of said first pair;

(c) wherein polarities of said portions are so arranged so that said magnet members rotate said valve member from its first to its second position as said piston approaches one end of said chamber and from its second to its first position as said piston approaches an opposite end of said chamber.

3. Apparatus in accordance with claim 2 wherein all of said portions are of an equal angular measure.

4. Apparatus in accordance with claim 3 wherein said portions measure approximately 90°.

5. Apparatus in accordance with claim 2 or 4 wherein portions of similar polarity of said first pair of magnet members are aligned axially, and wherein portions of opposite polarity of said second pair of magnet members are aligned axially.

6. Apparatus in accordance with claim 2 or 4 wherein portions of opposite polarity of said first pair of magnet members are aligned axially, and wherein portions of similar polarity of said second pair of magnet members are aligned axially.

7. Apparatus in accordance with claim 2 wherein said magent member portions are sufficiently strong to effect rotation of said valve member while yet allowing movement of said piston along the axial length of said chamber.

8. Apparatus in accordance with claim 2 further comprising means for preventing rotation of said valve member until said piston is closely proximate and end of said chamber.

9. Apparatus in accordance with claim 8 wherein said preventing means comprises:

(a) a track member mounted within said housing at each end of said chamber, each of said track members having a radially inwardly facing wall with a pair of axially extending, generally parallel slots and a third slot intersecting said pair of slots generally perpendicularly and proximate one of said second pair magnet members formed therein; and (b) a track rider extending generally radially from said valve member proximate each of said first pair magnet members and being axially aligned with one of said pair of generally parallel slots when said valve member is in its first and second positions, said rider being sized similarly to said slots;

(c) wherein, as said piston approaches one end of said chamber, said rider will enter a first of said slots and ride along said first slot until said rider can enter said third slot.

10. Apparatus in accordance with claim 9 wherein a second of said slots, at an entrance thereof, is enlarged and tapered more narrowly away from said entrance in order to facilitate entry of said rider into said second slot.

* * * * *